US005404120A

United States Patent [19]

Agahi-Kesheh

[11] Patent Number: 5,404,120

[45] Date of Patent: Apr. 4, 1995

[54] DIELECTRIC FILTER CONSTRUCTION HAVING RESONATORS OF TRAPEZOIDAL CROSS-SECTIONS

[75] Inventor: Darioush Agahi-Kesheh, Mundelein, Ill.

[73] Assignee: Motorola, Inc., Schaumburg, Ill.

[21] Appl. No.: 947,606

[22] Filed: Sep. 21, 1992

[51] Int. Cl.[6] ..... H01P 1/205

[52] U.S. Cl. ..... 333/206; 333/134

[58] Field of Search ..... 333/202, 203, 206, 207, 333/222, 223, 134; 455/82, 78

[56] References Cited

U.S. PATENT DOCUMENTS

| | | | |
|---|---|---|---|
| 4,431,977 | 2/1984 | Sokola et al. | 333/206 |
| 4,742,562 | 5/1988 | Kommrusch | 333/202 X |
| 4,823,098 | 4/1989 | DeMuro et al. | 333/206 |
| 4,829,274 | 5/1989 | Green et al. | 333/202 |
| 4,879,533 | 11/1989 | de Muro et al. | 333/202 X |
| 5,208,566 | 5/1993 | Kenoun et al. | 333/206 |

FOREIGN PATENT DOCUMENTS 2109641A 6/1983 United Kingdom .

OTHER PUBLICATIONS

IEEE Transactions on Microwave Theory and Techniques, vol. 39, No. 6, Jun. 1991, New York, USA, pp. 1040–1043.

*Primary Examiner*—Seungsook Ham

*Attorney, Agent, or Firm*—Daniel W. Juffernbruch; Rolland R. Hackbart

[57] ABSTRACT

A dielectric filter having at least two adjacently-positioned resonators extended therethrough. The two adjacently-positioned resonators are of trapezoidal cross-sections to form thereby trapezoidal resonators. By suitable selection of the configurations of such resonators, the amount of coupling between such adjacent resonators may be controlled. For instance, a minor base side of the first trapezoidal resonator may be positioned adjacent to a corresponding minor base side of the adjacent trapezoidal resonator, or a major base side of the first trapezoidal resonator may be positioned adjacent to a major base side of the adjacent trapezoidal resonator, or a minor base side of the first trapezoidal resonator may be positioned adjacent to a major base side of the second trapezoidal resonator. Such electromagnetic coupling between the adjacent resonators is controlled by the relative configurations of such resonators rather than by increasing the spacings between such adjacent resonators.

19 Claims, 4 Drawing Sheets

100

200

300

400

500

DIELECTRIC FILTER CONSTRUCTION HAVING RESONATORS OF TRAPEZOIDAL CROSS-SECTIONS

BACKGROUND OF THE INVENTION

The present invention relates generally to dielectric filters, and, more particularly, to a dielectric filter construction having at least two resonators of trapezoidal-shaped cross-sections.

Advancements in the field of radio electronics have permitted the introduction and commercialization of an ever-increasing array of radio communication apparatus. Advancements in electronic circuitry design have also permitted increased miniaturization of the electronic circuitry comprising such radio communication apparatus. As a result, an ever-increasing array of radio communication apparatus, comprised of ever-smaller electronic circuitry, has permitted the radio communication apparatus to be utilized more conveniently in an increased number of applications.

A radio transceiver, such as a radiotelephone utilized in a cellular, communication system, is one example of radio communication apparatus which has been miniaturized to be conveniently utilized in an increased number of applications. Additional efforts to miniaturize further the electronic circuitry of such radio transceivers, as well as other radio communication apparatus, are being made. Such further miniaturization of the radio transceivers will further increase the convenience of utilization of such apparatus, and will permit such apparatus to be utilized in further increased numbers of applications.

Pursuant to such efforts to miniaturize further the electronic circuitry comprising radio transceivers, as well as other radio communication apparatus, size minimization of the electronic circuitry comprising such is a critical design goal during circuit design of such circuitry.

Dielectric block filters, comprised of a ceramic material, frequently comprise a portion of the circuitry of such radio transceivers. Such dielectric block filters are advantageously utilized for the reason that such filters exhibit good filter characteristics at frequencies (typically in the megahertz and gigahertz range) at which such transceivers usually are operative.

To form a filter of a block of dielectric material, holes are formed to extend through the block, typically to extend between top and bottom surfaces of the block. More particularly, such holes form cylindrical cavities which extend between such top and bottom surfaces of the block. Sidewalls defining such cylindrical cavities are coated with an electrically-conductive material, such as a silver-containing material.

Typically, substantial portions of the outer surfaces of the dielectric block are similarly coated with the electrically-conductive material. Portions of a top surface of the dielectric block are also typically coated with the electrically-conductive material. Uncoated portions of the top surface of the dielectric block separate portions of the top surface of the dielectric block which are coated with the electrically-conductive material. Adjacent portions of the top surface of the dielectric block coated with the electrically-conductive material form capacitive plates which are separated by such uncoated portions. Pairs of capacitive plates, so formed, form capacitors thereby.

Because of the coating of the electrically-conductive material upon the sidewalls which define the cavities extending through the dielectric block, such cavities form resonators which resonate at frequencies determined by the lengths of such cavities through the dielectric block. Electromagnetic coupling between adjacent ones of the resonators formed thereby (and, to a lesser extent, between nonadjacent ones of the resonators), and the capacitors formed of the top surface of the dielectric block together define a filter having filter characteristics for filtering a signal to such dielectric filter. Appropriate selection of the component values of the filter formed thereby is, of course, determinative of the precise filter characteristics of such filter. The component values of the capacitors formed of the painted portions formed upon the top surface of the dielectric block may be altered by altering two parameters. First, the spacing between the coated portions of the top surface of the dielectric filter and the dimensions of such coated portions may be altered. Second, the spacings between such cavities as well as the amount of electrically-conductive material coated upon the sidewalls defining such cavities may be altered, also to alter the amount of electromagnetic coupling between adjacent ones of the resonators.

Historically, the component values of the elements comprising the filter have been selected by altering the two above-noted parameters. Namely, the capacitive values of the capacitive elements disposed upon the top surface of the dielectric filter have been altered by changing the physical dimensions of the coated portions forming the capacitive plates on the top surface and altering the spacing between such capacitive plates. And, spacings between adjacent ones of the resonators have been altered.

Alteration of the capacitive values of the capacitive elements formed upon the top surface of the dielectric block has increasingly become an impractical means for altering the filter characteristics of the dielectric filter. As the physical dimensions of the dielectric filters are reduced, the surface area of the top surface of such dielectric filters are correspondingly reduced. The capacitive values of the capacitive elements are dependent upon the physical dimensions of the coated portions of the top surface as well as the respective spacings between such coated portions; the reduction in the surface area of the top surface of the dielectric filter limits the dimensions of the capacitive plates of the capacitive elements as well as the spacings between such capacitive plates. As a result, the range of capacitive values of which the capacitive elements formed therefrom is reduced. Accordingly, alteration of the filter characteristics of a dielectric filter has become increasingly limited.

Similarly, alteration of the spacings between the adjacent ones of the resonators formed of the cavities extending through the dielectric filter has also increasingly become an impractical means of altering the filter characteristics of the dielectric filter. As the physical dimensions of the dielectric filter are reduced, permissible spacings between adjacent ones of the resonators are of increasingly smaller maximum distances. As a result, the amounts of couplings between adjacent ones of the resonators are of increasingly limited ranges of values. Accordingly, alteration of the filter characteristics of the dielectric filter in such a manner has become increasingly limited.

By altering the dimensions of the cavities forming the resonators and by altering the dielectric material separating adjacent ones of the resonators, the electromagnetic couplings between adjacent ones of the resonators may be altered. For instance, rather than forming the cavities to be cylindrical in dimension, the sidewalls defining such cavities may be of elliptical cross-sectional configurations. Alteration of the dielectric material separating the adjacent ones of the resonators may be effectuated by forming notches along side surfaces of the dielectric filter between the adjacent ones of the resonators. In such instances, air rather than the ceramic material of the dielectric filter comprises portions of the dielectric material separating the adjacent ones of the resonators. When such notches are formed to extend too deeply into the side surfaces of the dielectric filter, the structural integrity of the filter may be compromised. Accordingly, alteration of the filter characteristics of a dielectric filter in such a manner may also be somewhat limited due to the need to maintain the structural integrity of the dielectric filter.

Accordingly, what is needed is a dielectric filter construction, and means for making such, which permits component elements thereof to be selected over a wide range of values without requiring increase in the physical dimensions of the filter.

SUMMARY OF THE INVENTION

The present invention, accordingly, advantageously provides a dielectric filter construction which permits the component values of the component elements comprising the dielectric filter to be of any of a wide range of values to permit thereby a filter to be constructed of any of many desired filter characteristics.

The present invention provides further advantages and features, the details of which will become more apparent by reading the detailed description of the preferred embodiments hereinbelow.

In accordance with the present invention, therefore, a filter construction for generating a filtered signal responsive to application of an input signal thereto is disclosed. The filter construction comprises a dielectric block defining top, bottom, arid at least first and second side surfaces. At least two longitudinally-extending resonators defined by sidewalls of cavities are formed to extend longitudinally along longitudinal axes thereof between the top and bottom surfaces of the dielectric block. The at least two resonators include a pair of adjacently-positioned resonators wherein a first resonator of the pair of adjacently-positioned resonators is of a trapezoidal cross-section having a first base side and a second base side extending in a parallel direction therewith. A second resonator of the pair of adjacently-positioned resonators is of a trapezoidal cross-section also having a first base side and a second base side. The first base side of the first resonator is positioned adjacent to the first base side of the second resonator. A coating of an electrically-conductive material substantially covers the bottom and the at least first and second side surfaces and the sidewalls of the cavities defining the at least two longitudinally-extending resonators, thereby to permit electromagnetic coupling between adjacent ones of the at least two resonators.

BRIEF DESCRIPTION OF THE DRAWINGS

The present invention will be better understood when read in light of the accompanying drawings in which.

DESCRIPTION OF THE PREFERRED EMBODIMENTS

Figure 1:
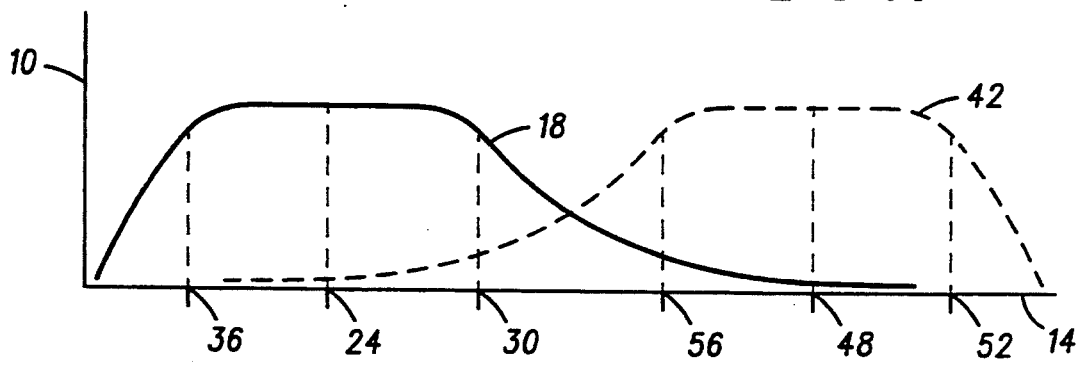
FIG. 1 is a graphical representation of the frequency response of a bandpass filter, and of a duplexer filter, of preferred embodiments of the present invention.

Turning first to the graphical representation of FIG. 1, the frequency response of a bandpass filter is graphically represented. Ordinate axis 10 is scaled in terms of a power-related value, such as decibels, and abscissa axis 14 is scaled in terms of frequency. Curve 18 is a plot of the frequency response of a bandpass filter over a range of frequencies. A bandpass filter is typically defined in terms of a center frequency, shown in the figure at the frequency designated by reference numeral 24, and upper and lower cutoff frequencies, designated in the figure by frequencies designated by reference numerals 30 and 36, respectively.

The graphical representation of FIG. 1 further shows curve 42, shown in hatch of the frequency response of a second bandpass filter having a center frequency 48 and upper and lower cutoff frequencies 52 and 56 of frequencies which do not overlap with the frequencies between the upper and lower cutoff frequencies 30 and 36 of the bandpass filter having a frequency response represented by curve 18.

As shall be noted hereinbelow, ceramic filters may be constructed to include two separate filters on a single ceramic block; such filters together form a duplexer filter.

The range of frequencies extending between the upper and lower cutoff frequencies of the bandpass filter define the pass band of the filter. Component portions of a signal applied to a bandpass filter of frequencies within the pass band of the filter are passed by the filter; component portions of the signal applied to the filter of frequencies beyond the pass band of the filter are attenuated by the filter. In the graphical representation of FIG. 1, frequencies between upper and lower cutoff frequencies 30 and 36 of the bandpass filter having a frequency response represented by curve 18 are passed by such filter; similarly, frequency component portions of a filter of frequencies between the upper and lower cutoff frequencies 52 and 56 of the bandpass filter having a frequency response represented by curve 42 are passed by such filter.

Figure 2:
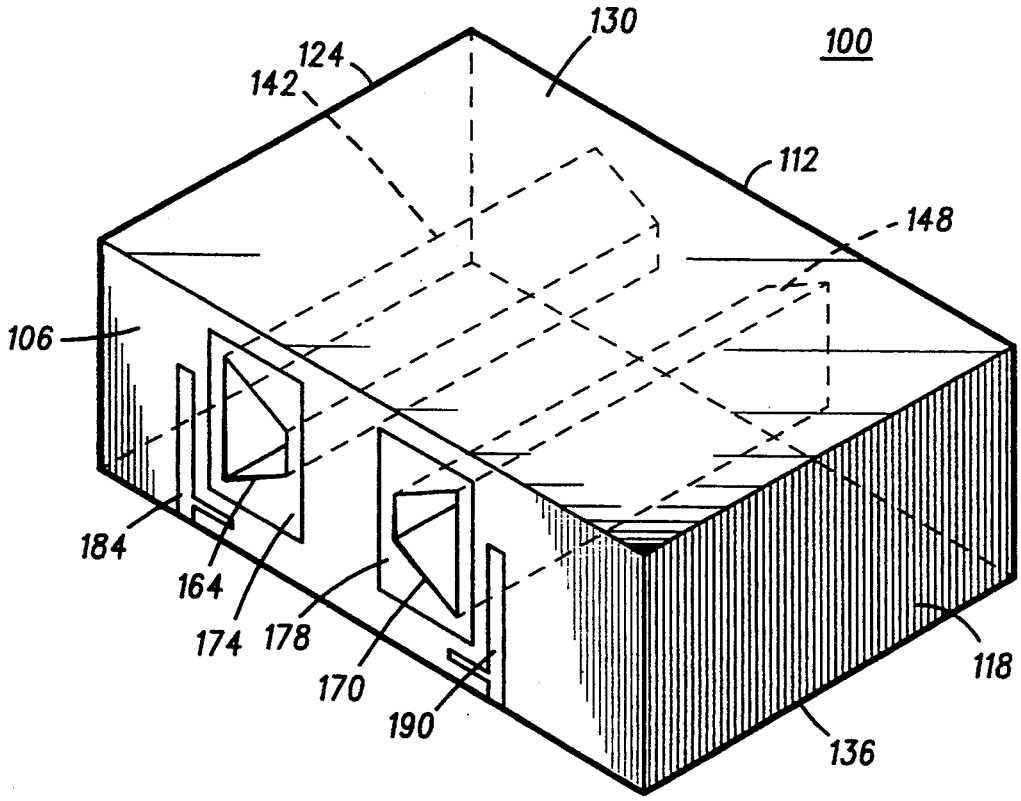
FIG. 2 is a perspective view of a bandpass, dielectric filter of a preferred embodiment of the present invention having a frequency response shown in the graphical representation of FIG. 1.

Turning next to the perspective view of FIG. 2, a dielectric filter, referred to generally by reference numeral 100, of a preferred embodiment of the present invention is shown. Filter 100 is generally block-like in configuration, and is comprised of a dielectric material. Filter 100 defines top surface 106, bottom surface 112, first side surface 118, second side surface 124, and front and rear side surfaces 130 and 136, respectively. A coating of an electrically-conductive material, typically a silver-containing material, is applied to substantial portions of bottom surface 112, and side surfaces 118, 124, 130 and 136.

At least two cavities, here indicated by reference numerals 142 and 148, are formed to extend longitudinally through the dielectric block between top surface 106 and bottom surface 112. Such longitudinally-extending cavities 142 and 148 define longitudinal axes which extend between top surface 106 and bottom surface 112. Both cavities 142 and 148 are of trapezoidal cross-sections and define trapezoidal openings 164 and 170 at top surface 106. (Similar such trapezoidal openings are defined at bottom surface 112.)

Sidewalls which define trapezoidal cavities 142 and 148 are also coated with the same electrically-conductive material.

Trapezoidal opening 164 defined upon top surface 106 is of dimensions corresponding to the dimensions of the cavity, as defined by the sidewalls extending through the dielectric filter at any location along the length of the filter. Similarly, trapezoidal opening 170 defined upon top surface 106 is also of dimensions corresponding to the dimensions of the cavity, as defined by the sidewalls extending through the dielectric filter at any location along the length of the filter.

Portions of top surface 106 are also coated with the electrically-conductive material which coats bottom surface 112 and side surfaces 118–136. As shown in FIG. 2, portions of top surface 106 about the peripheries of openings 164 and 170 are coated by such electrically-conductive material. Coated portions 174 and 178 are separated from one another and thereby form capacitive plates of a capacitive element of a capacitive value corresponding to the surface area of such coated portions 174 and 178 and the separation distances therebetween. Coated portions 184 and 192 formed upon top surface 106 are also shown in the figure. Such coated portions extend to rear side surface 136 and are coupled to input and output electrodes formed upon the rear side surface 136. It should be noted that the configuration of the coated portions shown in the figure are simplified for purposes of illustration.

Figure 3:
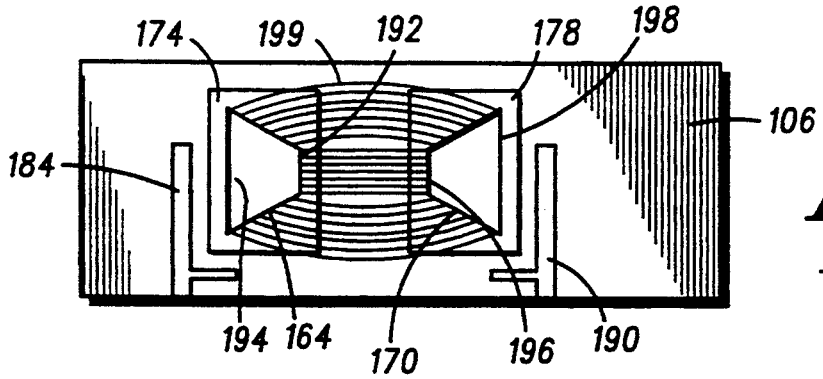
FIG. 3 is a view taken from above the top surface of the dielectric filter of FIG. 2.

FIG. 3 is an enlarged view taken from above top surface 106 of filter 100 of FIG. 2. The configurations of trapezoidal openings 164 and 170 of cavities 142 and 148 which extend through filter 100 are again shown. Trapezoidal opening 164 includes first base side 192 and second base side 194. Similarly, second trapezoidal opening 170 includes first base side 196 and second base side 198. As illustrated, first base side 192 comprises a minor base side of trapezoidal opening 164 and second base side 194 comprises a major base side of trapezoidal opening 164. Also as illustrated, first base side 196 of trapezoidal opening 170 comprises a minor base side of opening 170, and second base side 198 comprises a major base side of the trapezoidal opening.

Electromagnetic field lines 199 are further illustrated in FIG. 3. Such field lines are representative of the electromagnetic coupling between resonators formed of cavities 142 and 148 (shown in FIG. 2) which define openings 164 and 170.

Figure 4:
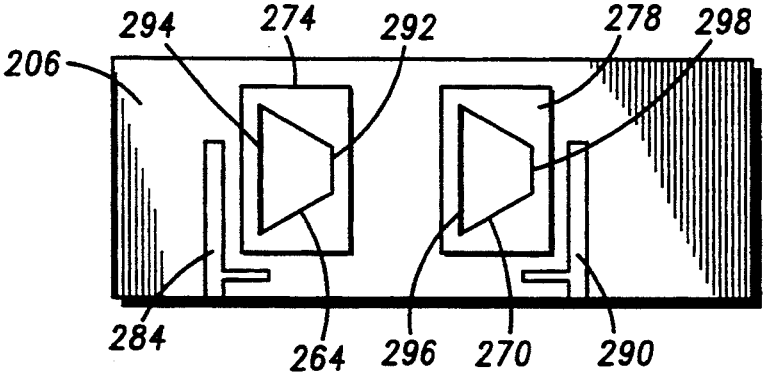
FIG. 4 is a plan view, similar to that of FIG. 3, but taken from above the top surface of a dielectric filter of a alternate, preferred embodiment of the present invention.

FIG. 4 is an enlarged view, similar to that of FIG. 3, but taken from above a top surface of a filter, here referred to generally by reference numeral 200, of an alternate, preferred embodiment of the present invention. Filter 200 is identical in all respects to that of filter 100 of FIGS. 2 and 3 but for the configuration of the cavities which extend through the dielectric filter.

Here, the cavities form, at top surface 206, openings 264 and 270 which are again trapezoidal in configuration. Coated portions 274 and 278 and 284 and 290 are also formed upon top surface 206 and are operative in manners similar to corresponding coated portions 174, 178, 184, and 190 of filter 100 of FIGS. 2–3. Again, first base side, here indicated by reference numeral 292, comprises a minor base side of opening 264, and second base side, here designated by reference numeral 294, comprises a major base side of trapezoidal opening 264. In this embodiment, however, first base side 296 of trapezoidal opening 270 comprises the major base side thereof, and second base side 298 comprises a minor base side of trapezoidal opening 270. Because the adjacent sides 292 and 296 of trapezoidal openings 264 and 270 (and corresponding cross-sections taken at any location along the length of the cavities which define such openings) are of dissimilar dimensions, the mount of electromagnetic coupling between adjacent resonators formed of such cavities differ with the amount of electromagnetic couplings between the resonators of filter 100 of FIGS. 2–3, and the filter characteristics of such filters differ.

Figure 5:
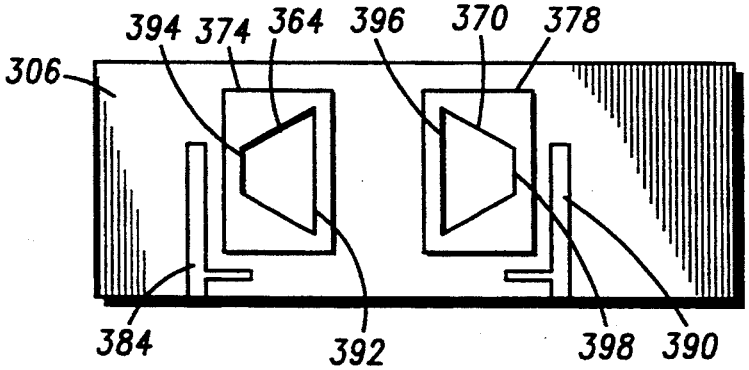
FIG. 5 is a plan view, similar to those of FIGS. 3–4, but taken from above the top surface of a dielectric filter of another, alternate, preferred embodiment of the present invention.

Turning next to the top view of FIG. 5, an end view, similar to those of FIGS. 3–4 but taken from above a top surface of another filter, here referred to generally by reference numeral 300, of another, alternate preferred embodiment of the present invention is shown. Filter 300 is identical in all respects to those of filters 100 and 200 of the preceding figures, but for the configuration of the cavities which extend through the dielectric filter.

Such cavities extend to top surface 306 of filter 300 to define trapezoidal openings 364 and 370 thereat. Similar to the embodiments of the preceding figures, portions of top surface 306 are coated with an electrically-conductive material. Such portions are indicated in the figure by reference numerals 374, 378, 384, and 390. In this embodiment, first base side 392 of trapezoidal opening 364 defines a major base side thereof and second base side 394 of trapezoidal opening 364 defines a minor base side thereof. And, first base side 396 of trapezoidal opening 370 defines a major base side and second base side 398 defines a minor base side thereof. (Again, corresponding cross-sections taken at any location along the length of the cavities which define such openings 364 and 370 may be similarly illustrated.) In this embodiment, adjacent sides 392 and 396 of resonaters formed of such cavities each comprise major base sides of trapezoidal sections, corresponding to base sides 392 and 396 at trapezoidal openings 364 and 370. Such configuration causes the electromagnetic coupling between such adjacent resonators to be of values which differ with corresponding couplings between adjacent resonators of the filters of the preceding figures. Accordingly, the filter characteristics of filter 300 of FIG. 5 differ with the filter characteristics of the filters of the preceding figures.

Figure 6:
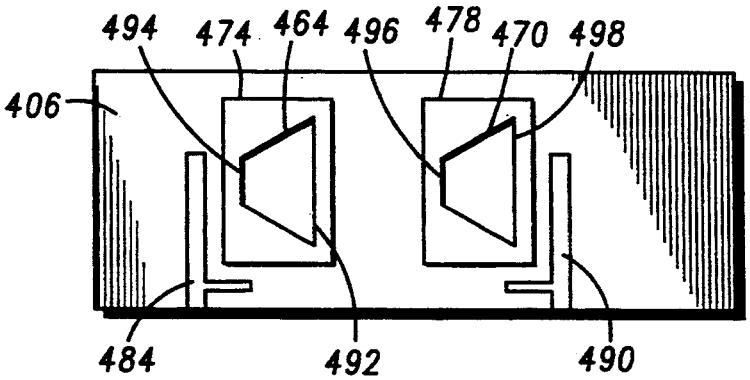
FIG. 6 is a plan view, similar to those of FIGS. 3–5, but taken from above the top surface of a dielectric filter of yet another, alternate, preferred embodiment of the present invention.

Turning next to FIG. 6, an end view, similar to those of FIGS. 3–5 but taken from above a top surface of a filter, here referred to generally by reference numeral 400, of another alternate, preferred embodiment of the present invention. Filter 400 is identical in all respects to those of filters 100–300 of the preceding figures, but for the configuration of the cavities which extend through the dielectric filter.

Here, the cavities which extend to top surface 406 define trapezoidal openings 464 and 470 at top surface 406. Portions of top surface 406 are coated with an electrically-conductive material; such portions are indicated by reference numerals 474, 478, 484, and 490. In this embodiment, first base side 492 of the trapezoidal opening 464 comprises a major base side and second base side 494 of trapezoidal opening 464 defines a minor base side. The cavity which defines opening 464 is similarly configured along the length thereof. And, first base side 496 of trapezoidal opening 470 comprises a minor base side thereof, and second base side 498 of trapezoidal opening 470 defines a major base side thereof. The cavity which defines opening 470 is similarly configured along the length thereof. Analogous to the embodiments of the preceding figures, the dimensions of the adjacent sides of the resonators formed of cavities which define openings 464 and 470 are determinative of the electromagnetic coupling between the adjacent ones of the resonators so formed. Thereby, the filter characteristics of filter 400 are dissimilar with those of various of the filters shown in the preceding figures.

In the preceding figures, the major base sides of the resonators formed of the trapezoidal cavities extending through the respective filters are each of similar dimensions. Also, the minor base sides of such resonators are also each of similar dimensions.

Figure 7:
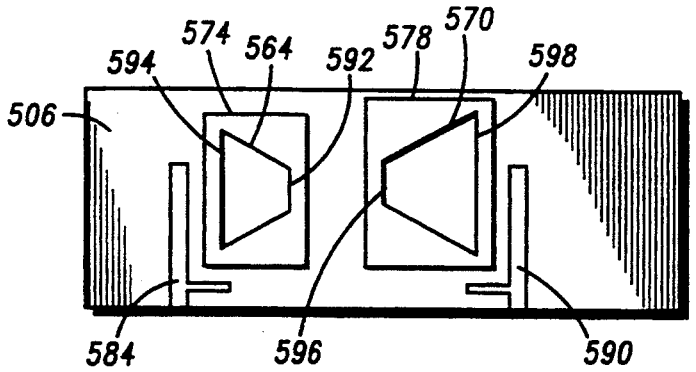
FIG. 7 is a plan view, also similar to those of the preceding figures, but taken from above the top surface of a dielectric filter of still another, alternate, preferred embodiment of the present invention.

FIG. 7 is an end view, here referred to generally by reference numeral 500. Again, similar to the filters of the preceding figures, filter 500 is identical to filters 100–400 of the preceding figures but for the configuration of the cavities which extend therethrough. The cavities extend to top surface 506 of filter 500 to define trapezoidal openings 564 and 570 thereat. Portions of surface 506 are coated with an electrically-conductive material; such portions are indicated in the figure by reference numerals 574, 578, 584, and 590. First base side 592 of trapezoidal opening 564 is a minor bass side thereof and second base side 594 of trapezoidal opening 564 is a major base side thereof. First base side of trapezoidal opening 570 comprises a minor base side thereof and second base side 598 comprises a major base side of the trapezoidal opening. The cavities which define openings 564 and 570 are similarly configured along the lengths of filter 500. In the embodiment, the dimensions of minor base sides comprising first base sides 592 and 596 are of dissimilar dimensions as are also the dimensions of major base sides comprising the second base sides of trapezoidal openings 594 and 598. Such configuration also alters the amount of electromagnetic coupling between such adjacent resonators relative to the amounts of electromagnetic couplings between corresponding adjacent resonators of the embodiments of the preceding figures. Other combinations of configurations are, of course, also similarly possible.

Figure 8:
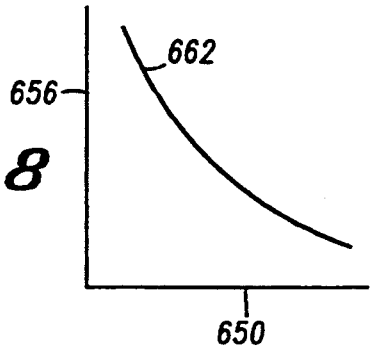
FIG. 8 is a graphical representation of the relationship between the mutual impedance between adjacently-positioned, trapezoidal resonators of a dielectric filter such as a dielectric filter shown in one of the preceding figures and the ratio of the major to minor bases of similarly-dimensioned resonators.

FIG. 8 is a graphical representation illustrating the relationship between the mutual impedance of two adjacently-positioned trapezoidal resonators configured in the configurations of filter 100 of FIGS. 2–3. (Mutual impedance is a quantity which is proportional to the amount of electromagnetic coupling between the adjacent resonators.) As illustrated in FIGS. 2–3, the minor base sides of the cavities forming such resonaters face one another. The minor base sides of such resonators so formed, are each similar in dimensions as are the major base sides thereof. The ratio of the dimensions of the minor base sides to the dimensions of the major base sides is plotted along abscissa axis 650 and the mutual 10 impedance of such resonators are plotted along ordinate axis 656 as a function of such ratio to form curve 662 thereby. As the plot of curve 662 illustrates, when the dimensions of the minor base sides of such resonators approach the dimensions of the major base sides thereof, the mutual impedance of such resonaters reaches a minimum. (It should be noted that when the dimension of the minor base side of a trapezoid is equal to the dimensions of the major base side, the trapezoid is of the configuration of a square.)

While similar such plots of corresponding relationships of pair of resonators of filters 200–400 of FIGS. 4–6 are not shown, such plots follow the same general pattern as that of curve 662 in that mutual impedance of the resonaters are of lowest values when the ratios between the major and minor base sides approach unity. It is noted that, when increased amounts of electromagnetic coupling exists between the adjacent resonaters, the mutual impedance therebetween decreases, and when the amounts of electromagnetic coupling between the adjacent resonators decreases, the mutual impedance between such resonaters increases. Such alteration in the configuration of the cavities would result in a curve plotted in a manner analogous to that of curve 662 but translated upwards or downwards relative to the location of curve 662.

Figure 9:
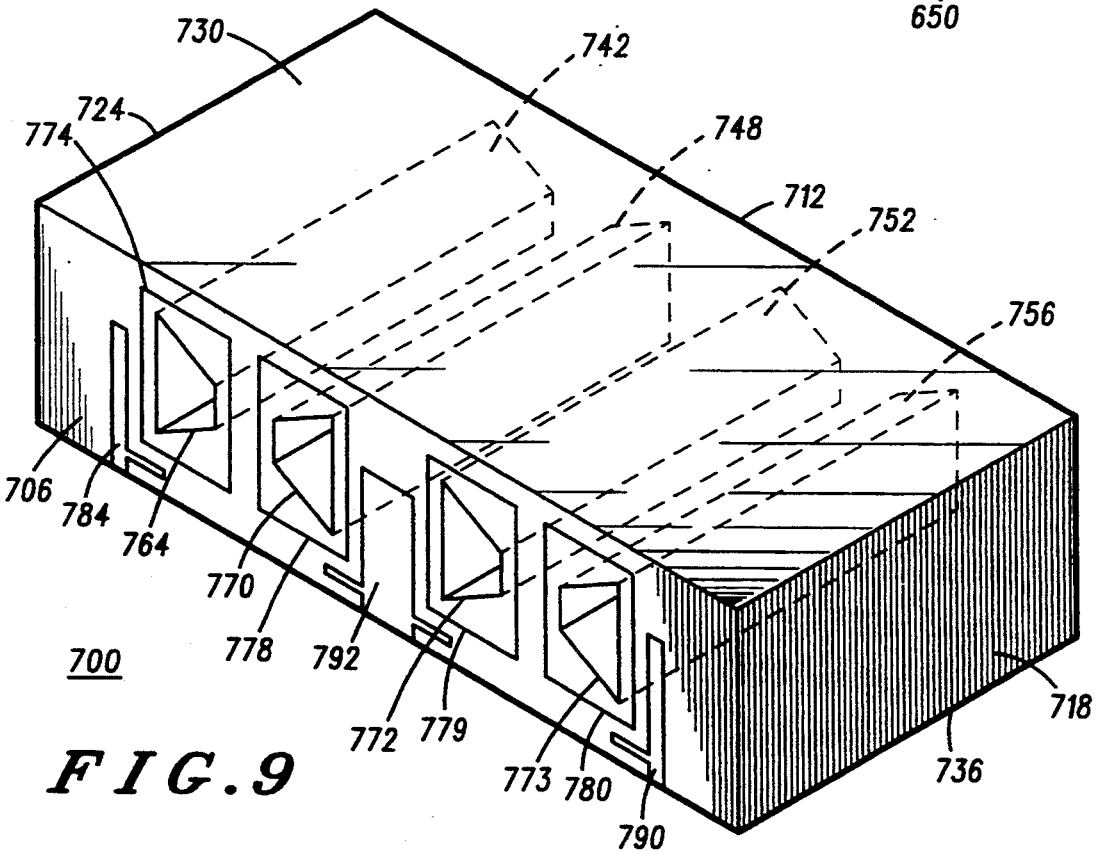
FIG. 9 is a perspective view of a duplexer filter of another preferred embodiment of the present invention.

FIG. 9 is a perspective view of another filter, here referred to generally by reference numeral 700, of another alternate, preferred embodiment of the present invention. Filter 700 is a duplexer filter which is a single-block construction having two separate filters disposed thereupon.

Filter 700 is comprised of top surface 706, bottom surface 712, first and second side surfaces 718 and 724, and front and rear side surfaces 730 and 736. Four longitudinally-extending cavities 742, 748, 752, and 756 extending therethrough. Each of the cavities 742–756 extend along longitudinal axes between top surface 706 and bottom surface 712.

Cavity 742 defines trapezoidal opening 764 upon the top surface 706; similarly cavity 748 defines trapezoidal opening 770 upon the top surface, cavity 752 defines trapezoidal opening 772 upon the top surface, and cavity 756 defines trapezoidal opening 773 at top surface 706. Portions of top surface 706 are further coated with an electrically-conductive material which also coats substantial portions of bottom surface 712 and side surfaces 718, 724, 730, and 736. Such portions include portions formed about the peripheries of openings 764, 770, 772, and 773, and are indicated in the figure by reference numerals 774,778, 779, and 780. Additional portions of top surface 706 are also coated with the electrically-conductive material to form input couplers 784, 790, and antenna coupler 792.

The left-hand side portion of filter 700 comprises a first band pass filter and a right-hand side portion of filter 700 comprises a second band pass filter wherein each band pass filter includes a pair of resonators formed of cavities 742–748 and 752–756, respectively.

Similar to the configurations of the resonators of filter 100 of FIGS. 2–3, cavities 742 and 748 are of trapezoidal cross-sections having minor base sides which face one another. Similarly, cavities 752 and 756 are of trapezoidal cross-sections also having minor base sides which face one another. Filter 700 may, of course, alternately be constructed to include different configurations of pairs of resonators including the configurations of filters 200–400.

Figure 10:
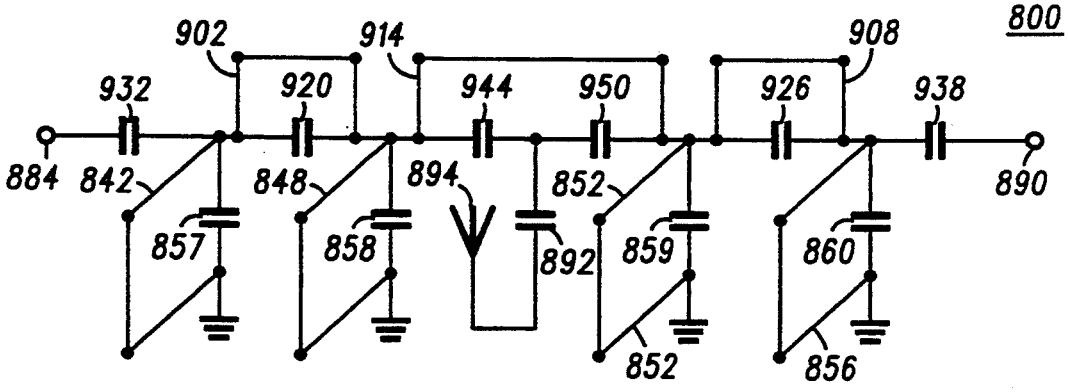
FIG. 10 is an electrical schematic of the duplexer filter shown in the perspective view of FIG. 9.

Turning next to the electrical schematic of FIG. 10, a circuit diagram of filter 700 is shown. Such electrical schematic is referred to generally by reference numeral 800. The resonators formed of the cavities extending through filter 700 are indicated in the schematic circuit of FIG. 10 by transmission lines 842, 848, 852, and 856. Resonators represented by transmission lines 842–856 are each capacitively loaded by capacitors 857, 858, 859, and 860, respectively, to an electrical ground plane.

Adjacent ones of the resonators (represented by transmission lines 842–856) are both inductively coupled and capacitively coupled to adjacent ones of the resonators. A first filter portion of the filter includes the resonators represented at the left-hand side portion of the figure, and a second filter portion is comprised of the resonators formed at the right-hand side portion of the figure. Input terminals of the first filter portion are indicated in the figure by point 884. Similarly, input terminals of the second filter portion are indicated in the figure by point 890. The first filter portion and the second filter portion are coupled, indicated by capacitor 892 to antenna 894.

As just noted, individual ones of the resonators (represented by transmission lines 842–856) are inductively coupled to resonators adjacent thereto. In the figure, inductive coupling between resonators represented by transmission lines 842 and 848 is indicated by transmission line 902. Similarly, inductive coupling between resonators represented by transmission lines 852 and 856 is indicated by transmission line 908 and inductive coupling between resonators represented by transmission lines 848 and 852 is indicated by transmission line 914.

Capacitive coupling between resonators represented by transmission lines 842 and 848 is indicated by capacitor 920, capacitive coupling between resonators represented by transmission lines 852 and 856 is indicated by capacitor 926, capacitive coupling between the input coupler represented by line 884 and the resonator represented by transmission line 842 is indicated by capacitor 932. Capacitive coupling between the input coupler represented by transmission line 890 and the resonator indicated by transmission line 856 is indicated by capacitor 938 and capacitive couplings between the antenna coupler represented by line 892 and the resonators represented by transmission lines 848 and 852 are indicated by capacitors 944 and 950.

By varying the configurations of the trapezoidal cavities 742 and 748, and 752 and 756, the filter circuit portions of duplexer filter 700 may be constructed to be of any of many filter characteristics. Because no notches are formed to extend along side surfaces of the dielectric block comprising the filter, the structural integrity of the filter is maintained. Additionally, because the amount of electromagnetic coupling between adjacent ones of the resonators may be controlled by selection of the configurations of the trapezoidal cavities forming such resonators, the filter characteristics of the filters formed therefrom may be selected to be of any desired filter characteristics without increasing the physical dimensions of the filter.

Figure 11:
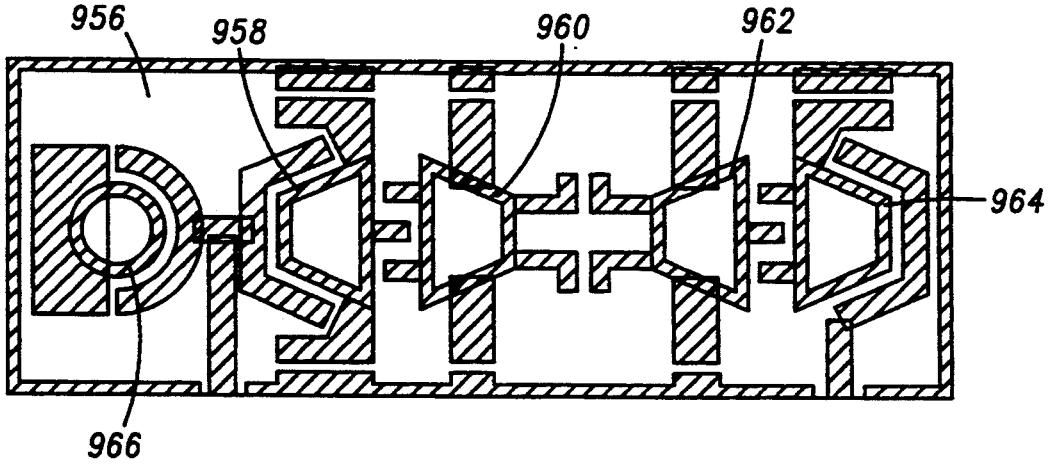
FIG. 11 is a plan view taken from above the duplexer filter of another alternate, preferred embodiment of the present invention.

FIG. 11 is a plan view of a top surface of a duplexer filter, similar to that of top surface 706 of filter 700 of FIG. 9, but of an alternate embodiment of the present invention. The top surface, here referred to by reference numeral 956, shows trapezoidal openings 958, 960, 962, and 964. Circular opening 966 is also formed upon top surface 956; circular opening 966 represents a resonator configured to form a filter transfer function zero and is utilized to alter the filter characteristics of the filter of which a resonator defining opening 966 forms a portion.

The embodiment of FIG. 11 is illustrated to show in greater detail the configuration of the portions of the electrically-conductive material coated upon the top surface of a typical duplexer filter of a preferred embodiment of the present invention. Such portions are indicated by the shaded portions 970 in the figure.

Figure 12:
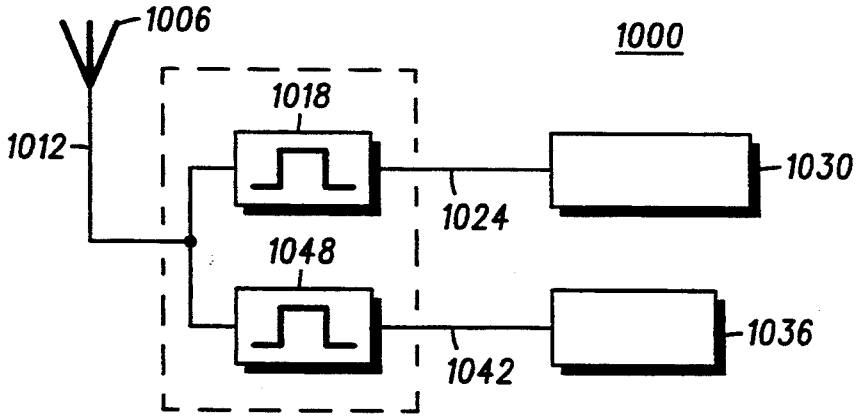
FIG. 12 is a block diagram of a radio transceiver of a preferred embodiment of the present invention which incorporates the duplexer filter of FIG. 8 as a portion thereof.

FIG. 12 is a block diagram of a radio transceiver, such as a radiotelephone operative in a cellular, communication system, and referred to here generally by reference numeral 1000. Transceiver 1000 includes a duplexer such as filter 700 shown in FIG. 9.

A signal transmitted to transceiver 1000 is received by antenna 1006, and a signal representative thereof is generated on line 1012 and applied to filter 1018. Filter 1018 corresponds to a first filter circuit portion of duplexer filter 700 of FIG. 9. Filter 1018 generates a filtered signal on line 1024 which is applied to receiver circuitries 1030. Receiver circuitry 1030 performs functions such down-conversion and demodulation of the received signal, as is conventional.

Transmitter circuitry 1006 is operative to modulate and up-convert in frequency a signal to be transmitted by transceiver 1000, and to generate a signal on line 1042 which is applied to filter circuit 1048. Filter circuit 1048 corresponds to a second filter portion of one of the filters of the duplexer of FIG. 9 and is operative to generate a filtered signal which is applied to antenna 1006 by way of line 1012 to be transmitted therefrom.

While the present invention has been described in connection with the preferred embodiments shown in the various figures, it is to be understood that other similar embodiments may be used and modifications and additions may be made to the described embodiments for performing the same function of the present invention without deviating therefrom. Therefore, the present invention should not be limited to any single embodiment, but rather construed in breadth and scope in accordance with the recitation of the appended claims.

What is claimed is:

1. A filter construction for generating a filtered signal responsive to application of an input signal thereto, said filter construction comprising:

a dielectric block defining top, bottom, and at least first and second side surfaces;

at least two longitudinally-extending resonators defined by side walls of cavities formed to extend longitudinally along longitudinal axes thereof between the top and bottom surfaces of the dielectric block, the at least two resonators including a pair of adjacently-positioned resonators wherein a first resonator of the pair of adjacently-positioned resonators is of a trapezoidal cross-section having a first base side and a second base side extending in a parallel direction therewith, and a second resonator of the pair of adjacently-positioned resonators is of a trapezoidal cross-section also having a first base side and a second base side; and wherein the first base side of the first resonator is positioned adjacent to the first base side of the second resonator; and a coating of an electrically-conductive material substantially covering the bottom and the at least first and second side surfaces of the dielectric block and the side walls of the cavities defining the at least longitudinally-extending resonators, thereby to permit electromagnetic coupling between adjacent ones of the at least two resonators.

2. The filter construction of claim 1 wherein said first base side of the trapezoidal cross-section of the first resonator comprises a major base side thereof and said second base side of the trapezoidal cross-section of the first resonator comprises a minor base side thereof.

3. The filter construction of claim 2 wherein said first base side of the trapezoidal cross-section of the second resonator comprises a minor base side thereof and said second base side of the trapezoidal cross-section of the second resonator comprises a major base side thereof.

4. The filter construction of claim 3 wherein the major base side comprising the first base side of the trapezoidal cross-section of the first resonator is of a length substantially equal to a corresponding length of the major base side comprising the second base side of the trapezoidal cross-section of the second resonator.

5. The filter construction of claim 3 wherein the minor base side comprising the second base side of the trapezoidal cross-section of the first resonator is of a length substantially equal to a corresponding length of the minor base side comprising the first base side of the trapezoidal cross-section of the second resonator.

6. The filter construction of claim 2 wherein said first base side of the trapezoidal cross-section of the second resonator comprises a major base side thereof and said second base side of the trapezoidal cross-section of the second resonator comprises a minor base side thereof.

7. The filter construction of claim 6 wherein the major base side comprising the first base side of the trapezoidal cross-section of the first resonator is of a length substantially equal to a corresponding length of the major base side comprising the first base side of the second resonator.

8. The filter construction of claim 6 wherein the minor base side comprising the second base side of the trapezoidal cross-section of the first resonator is of a length substantially equal to a corresponding length of the minor base side comprising the second base side of the second resonator.

9. The filter construction of claim 1 wherein said first base side of the trapezoidal cross-section of the first resonator comprises a minor base side thereof and said second base side of the trapezoidal cross-section of the first resonator comprises a major base side thereof.

10. The filter construction of claim 9 wherein said first base side of the trapezoidal cross-section of the second resonator comprises a minor base side thereof and said second base side of the trapezoidal cross-section of the second resonator comprises a major base side thereof.

11. The filter construction of claim 10 wherein the major base side comprising the second base side of the first resonator is of a length substantially equal to a corresponding length of the major base side comprising the second base side of the second resonator.

12. The filter construction of claim 10 wherein the minor base side comprising the first base side of the first resonator is of a length substantially equal to a corresponding length of the minor base side comprising the first base side of the second resonator.

13. The filter construction of claim 9 wherein said first base side of the trapezoidal cross-section of the second resonator comprises a major base side thereof and said second base side of the trapezoidal cross-section of the second resonator comprises a minor base side thereof.

14. The filter construction of claim 13 wherein the major base side comprising the second base side of the first resonator is of a length substantially equal to a corresponding length of the major base side comprising the first base side of the second resonator.

15. The filter construction of claim 13 wherein the minor base side comprising the first base side of the first resonator is of a length substantially equal to a corresponding length of the minor base side comprising the second base side of the second resonator.

16. The filter construction of claim 1 wherein the first base side of the trapezoidal cross-section of the first resonator and the first base side of the trapezoidal cross-section of the second resonator extend in parallel directions.

17. The filter construction of claim 1 wherein the second base side of the trapezoidal cross-section of the first resonator and the second base side of the trapezoidal cross-section of the second resonator extend in parallel directions.

18. A multi-passband filter construction formed of a dielectric block defining top, bottom, and at least first and second side surfaces, said filter construction comprising: a first filter circuit portion for generating a first filtered signal responsive to application of a first input signal thereto, the first filter circuit portion having;

at least two longitudinally-extending resonators defined by side walls of cavities formed to extend longitudinally along longitudinal axes thereof between the top and bottom surfaces of the dielectric block, the at least two resonators including a pair of adjacently-positioned resonators wherein a first resonator of the pair of adjacently-positioned resonators is of a trapezoidal cross-section having a first base side and a second base side extending in a parallel direction therewith, and a second resonator of the pair of adjacently-positioned resonators is of a trapezoidal cross-section also having a first base side and a second base side; and wherein the first base side of the first resonator is positioned adjacent to the first base side of the second resonator;

a second filter circuit portion for generating a second filtered signal responsive to application of a second input signal thereto, the second filter circuit portion having at least one resonator formed to extend longitudinally between the top and bottom surfaces of the dielectric block; and a coating of an electrically-conductive material substantially covering the bottom and the at least first and second side surfaces of the dielectric block and the side walls of the cavities defining the at least two longitudinally-extending resonators of the first filter circuit portion and the at least one longitudinally-extending resonator of the second filter circuit portion.

19. In a radio transceiver having transmitter circuitry for generating a transmit signal and receiver circuitry for receiving a receive signal, the combination with the transmitter circuitry and the receiver circuitry of a duplexer filter construction formed of a dielectric block defining top, bottom, and at least first and second side surfaces, said duplexer filter construction comprising:

a first filter circuit portion having at least two longitudinally-extending resonators defined by side walls of cavities formed to extend longitudinally along longitudinal axes thereof between the top and bottom surfaces of the dielectric block, the at least two resonators including a pair of adjacently-positioned resonators wherein a first resonator of the pair of adjacently-positioned resonators is of a trapezoidal cross-section having a first base side and a second base side extending in a parallel direction therewith, and a second resonator of the pair adjacently-positioned resonators is of a trapezoidal cross-section also having a first base side; and wherein the first base side of the first resonator is positioned adjacent to the first base side of the second resonator;

a second filter circuit portion having at least one resonator formed to extend longitudinally between the top and bottom surfaces of the dielectric block; and a coating of an electrically-conductive material substantially covering the bottom and the at least first and second side surfaces of the dielectric block and the side walls of the cavities defining the at least two longitudinally-extending resonators of said first filter circuit portion and the at least one longitudinally-extending resonator of said second filter circuit portion.

* * * * *